United States Patent [19]

Knill

[11] Patent Number: 4,966,361

[45] Date of Patent: Oct. 30, 1990

[54] DAMPED ROTATING PLATFORM FOR PARKS

[75] Inventor: Gary G. Knill, Princeton, Canada

[73] Assignee: Paris Playground Equipment Inc., Paris, Canada

[21] Appl. No.: 392,882

[22] Filed: Aug. 14, 1989

[51] Int. Cl.[5] ..... A63G 1/12

[52] U.S. Cl. ..... 272/33 R; 272/28 R

[58] Field of Search ..... 272/28 R, 33 R, 39, 272/285

[56] References Cited

U.S. PATENT DOCUMENTS 1,654,231 12/1927 Arers ..... 272/33 R
3,424,132 1/1969 Fischer et al. ..... 272/39 X
4,811,942 3/1989 Rusk ..... 272/33 R

FOREIGN PATENT DOCUMENTS 3234279 3/1984 Fed. Rep. of Germany .... 272/28 R
2133996 8/1984 United Kingdom ..... 272/28 R

*Primary Examiner*—Richard E. Chilcot, Jr.
*Attorney, Agent, or Firm*—Shoemaker and Mattare, Ltd.

[57] ABSTRACT

A rotating platform for play parks is damped by utilizing the principle of a shock-absorbing fluid cylinder. As the platform rotates, the length of at least one fluid cylinder is caused to change, thus resisting rotation of the platform. This discourages abuse of the platform by older children seeking to rotate the platform at a high speed while a younger child is trapped on it.

4 Claims, 2 Drawing Sheets

DAMPED ROTATING PLATFORM FOR PARKS

This invention relates generally to play structures used in parks.

BACKGROUND OF THE INVENTION

City parks and playgrounds are typically provided with an assortment of play structures intended for use by children. These typically include slides, swings and climbing structures.

Another such playground structure is the rotating platform, consisting of a circular deck from six feet to ten feet in diameter, mounted for free rotation about a vertical axis. The platform typically has handrails for hanging on during use.

One of the problems that has arisen in playgrounds and parks has to do with abuse of the rotating platform. Mischievous older children will sometimes trap a younger child in the centre of the rotating platform, while they stand on the ground and spin the platform so fast that the young child cannot get off the platform without injury.

GENERAL DESCRIPTION OF THIS INVENTION

In view of the foregoing problem, it is desirable to provide a rotating platform structure which resists being rotating at high speeds.

Accordingly, it is an object of one aspect of this invention to provide a rotating platform in which rotation of the platform is resisted by at least one damping cylinder, thus discouraging older children from standing on the ground and rotating the platform at high speeds.

More particularly, this invention provides a child's play structure, comprising:

a central, non-rotating support means, a platform large enough to support at least one child, mounting means pivotally mounting the platform to the support means in such a way that the platform can rotate about a substantially vertical axis, and movement resisting means including at least one hydraulic cylinder shock absorber mounted between a first location on the platform and a second location on the support means which is eccentric with respect to said vertical axis, such that, as the platform rotates, the distance between said first and second locations varies, whereby said at least one shock absorber is forced to change its length, thus causing the platform rotation to be resisted.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
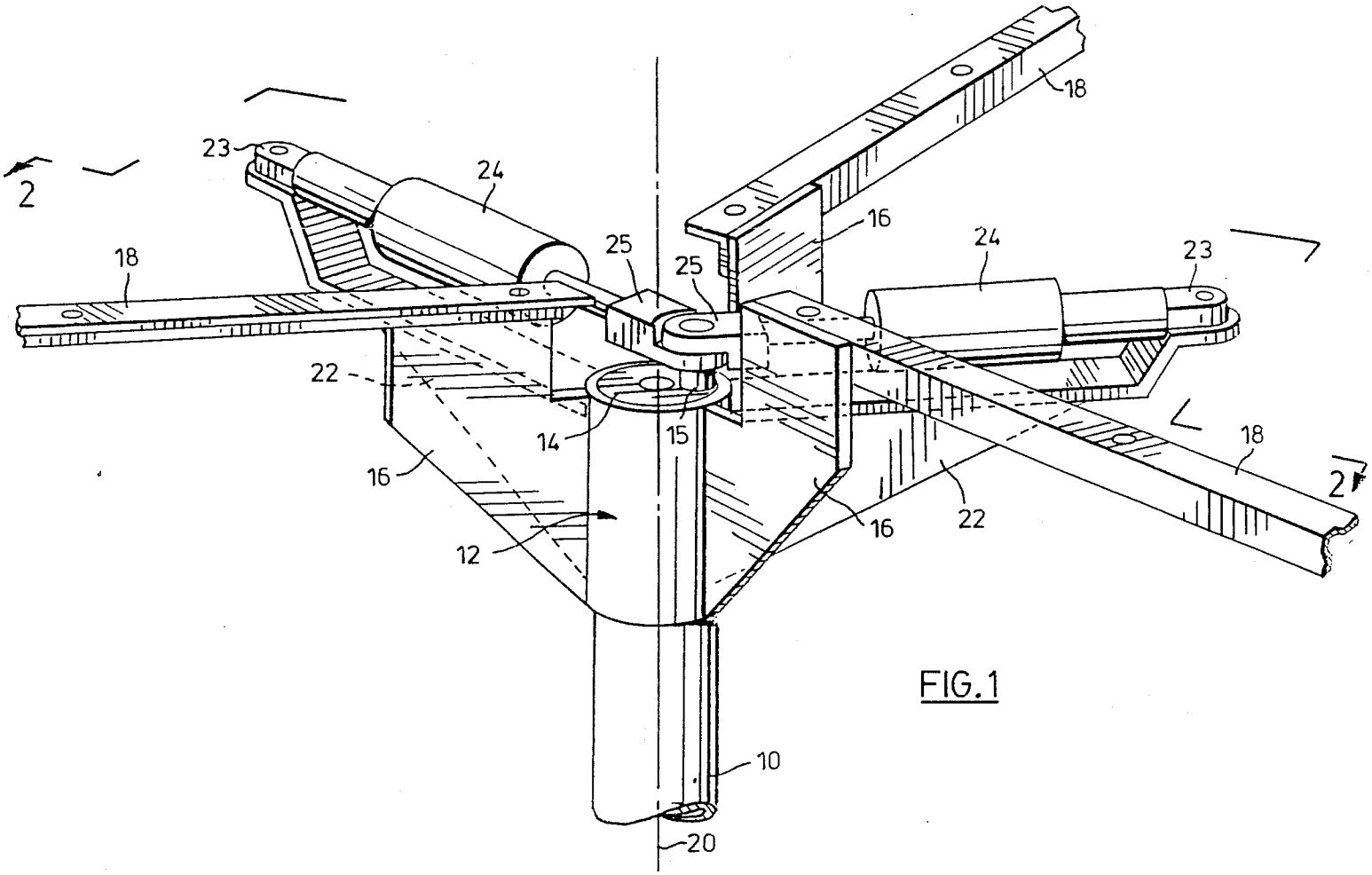
FIG. 1 is a perspective view of the damping structure of this invention.

Attention is first directed to FIG. 1, which shows a non-rotating base tube 10 about which a freely rotating collar 12 is mounted. The tube 10 extends to the top edge of the rotatable collar 12, and presents a non-rotating surface 14 at the top. Fixed to the surface 14 is an eccentrically located pin 15.

Figure 2:
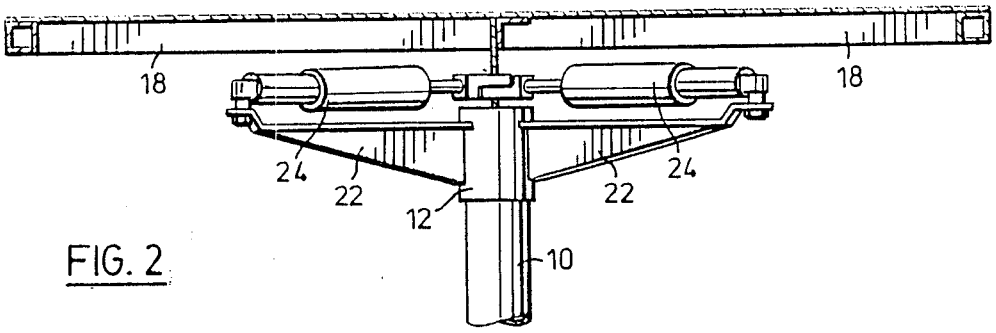
FIG. 2 is a side elevational view thereof.

Deck frame gussets 16 are welded at 120° intervals around the rotatable collar 12, extending radially away therefrom. The gussets 16 in turn support angle bars 18 to which the top deck 19 (see FIG. 2) is secured. The angle bars 18 can be secured to the respective gussets 16 by welding, bolting, or any other suitable manner.

It will be noted that the angle bars 18 stop short of the central axis 20 of the rotating assembly, and that the gussets 16 are cut away at their inner edges just above the rotatable collar 12.

Two flanges 22 are also affixed to the rotatable collar 12, each flange 22 supporting at its outer extremity one end 23 of a hydraulic cylinder 24 which acts as a shock absorber. The inner end 25 of each hydraulic cylinder 24 is connected to the pin 15 so as to be pivotal thereabout.

It will be appreciated that, because the pin 15 is offset from the centre line 20 about which the platform rotates, any rotation of the platform requires both of the hydraulic cylinders 24 to change their lengths through a regular cycle. Since the hydraulic cylinders 24 resist any change in length, there will be a corresponding resistance to the rotation of the platform. In particular, high-speed rotation of the platform will be damped down, thus requiring a great deal of energy to be expended in order to maintain high speed. This effect will discourage the more mischievous children from abusing the rotating platform.

One suitable construction for the hydraulic cylinders 24 utilizes oil and an internal piston with a small aperture through it. In order to change the length of the unit, the piston must be forced through the oil, and the oil must pass through the small aperture to allow such movement. Rapid movement of the piston through the oil is more strongly resisted than slower movement.

It will also be evident that other kinds of damping cylinders, for example air cylinders, can be utilized to resist high-speed rotation of the platform.

Figure 3:
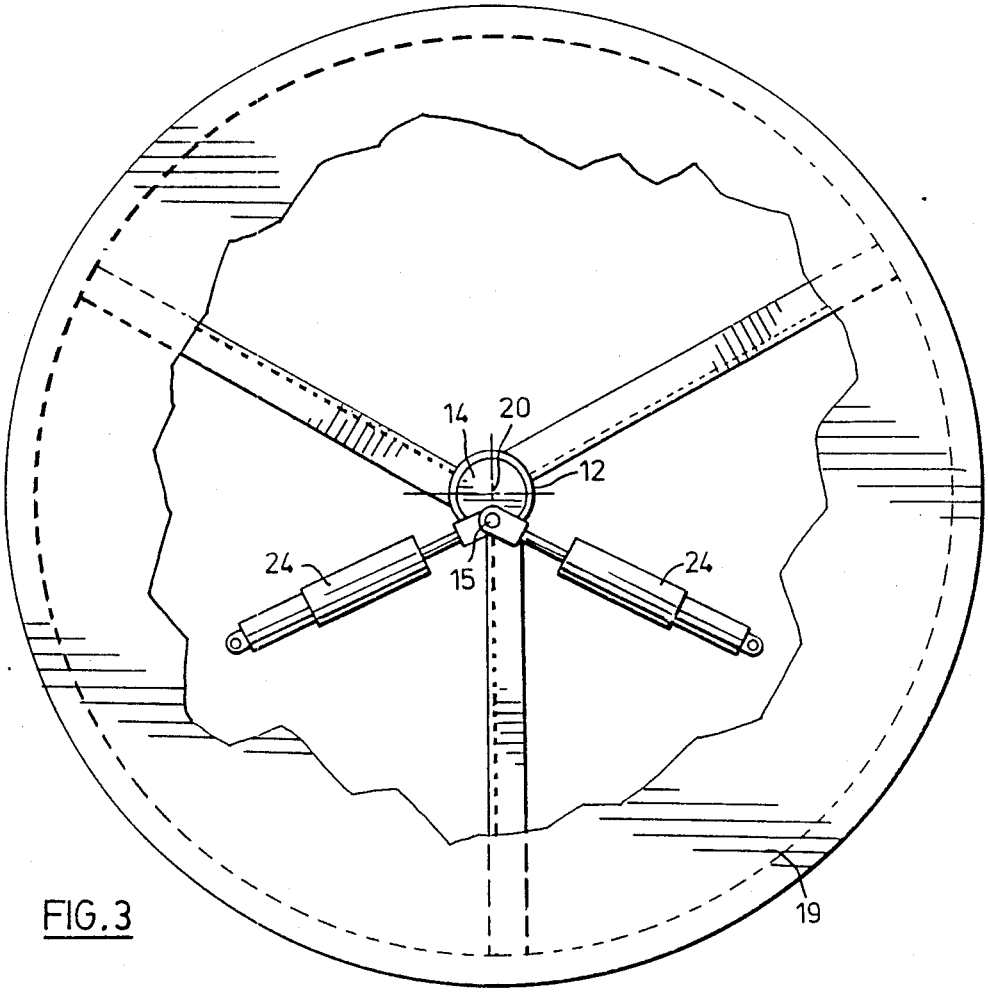
FIG. 3 is a schematic plan view, partly broken away, to show the disposition of the hydraulic damping cylinders.

FIG. 3 shows that the hydraulic cylinders 24 are mounted with an angle of approximately 120° between them. This construction ensures that, when either of the cylinders is at top or bottom dead centre, the other cylinder will be undergoing movement. The effect of this arrangement is to provide a smooth rather than a jerky resistance to platform rotation.

While one embodiment of this invention has been described above and illustrated in the accompanying drawings, it will be evident to those skilled in the art that changes and modifications may be made therein without departing from the essence of this invention, as set forth in the appended claims.

The embodiments of the invention in which an exclusive property or privilege is claimed are defined as follows:

1. A child's play structure comprising:

a central, non-rotating support means, a platform large enough to support at least one child, mounting means pivotally mounting the platform to the support means in such a way that the platform can rotate about a substantially vertical axis, and movement resisting means including at least one hydraulic cylinder shock absorber mounted between a first location on the platform and a second location on the support means which is eccentric with respect to said vertical axis, such that, as the platform rotates, the distance between said first and second locations varies, whereby said at least one shock absorber is forced to change its length, thus causing the platform rotation to be resisted.

2. The structure claimed in claim 1, in which the movement resisting means is constituted by two hydraulic cylinder shock absorbers set at an obtuse angle with respect to each other.

3. The structure claimed in claim 1, in which the support means is an upright post having an upper end, the mounting means including a substantially cylindrical collar mounted rotatably to the post through bearings, the platform being in turn supported from said collar whereby the said vertical axis is substantially coincident with the axis of the collar, said second location being defined by a pin projecting upwardly from and supported by the said upper end of the upright post.

4. The structure claimed in claim 3, in which the movement resisting means is constituted by two cylinder shock absorbers set at an obtuse angle with respect to each other.

* * * * *